US006168254B1

(12) United States Patent
Karita et al.

(10) Patent No.: US 6,168,254 B1
(45) **Date of Patent: *Jan. 2, 2001**

(54) INK JET RECORDING APPARATUS

(75) Inventors: Seiichiro Karita, Yokohama; Masaki Inaba, Kawasaki; Yutaka Koizumi, Yokohama; Tsuyoshi Orikasa, Musashimurayama; Toshio Kashino, Chigasaki; Shuji Koyama, Kawasaki; Haruhiko Terai, Yokohama; Kimiyuki Hayasaki, Yokohama; Akira Goto, Yokohama; Kouichi Omata, Kawasaki; Takayuki Ono, Kawasaki; Kiyomi Aono, Kawasaki; Hiroki Tajima, Machida, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/916,948

(22) Filed: Aug. 25, 1997

Related U.S. Application Data

(63) Continuation of application No. 08/398,942, filed on Mar. 2, 1995, now abandoned.

(30) Foreign Application Priority Data

Mar. 4, 1994 (JP) ..... 6-034929
Oct. 31, 1994 (JP) ..... 6-267064

(51) Int. Cl.[7] ..... B41J 2/015

(52) U.S. Cl. ..... 347/20

(58) Field of Search ..... 347/20, 65, 108

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,629,926 | 12/1986 | Siegal | 310/331 |
| 4,723,129 | 2/1988 | Endo et al. | 346/1.1 |
| 4,740,796 | 4/1988 | Endo et al. | 346/1.1 |
| 4,947,191 | 8/1990 | Nozawa et al. | 346/140 R |
| 5,006,867 | 4/1991 | Koizumi et al. | 346/140 R |
| 5,148,192 | 9/1992 | Izumida et al. | 346/140 R |
| 5,172,134 | 12/1992 | Kishida et al. | 346/1.1 |

(List continued on next page.)

FOREIGN PATENT DOCUMENTS

| | | |
|---|---|---|
| 0 419 180 | 3/1991 | (EP) . |
| 0440469 | 8/1991 | (EP) . |
| 0593040 | 4/1994 | (EP) . |
| 2 240 514 | 8/1991 | (GB) . |
| 59-123670 | 7/1984 | (JP) . |
| 59-138461 | 8/1984 | (JP) . |
| 6-126943 | 5/1994 | (JP) . |

*Primary Examiner*—Fred L. Braun
(74) *Attorney, Agent, or Firm*—Fitzpatrick, Cella, Harper & Scinto

(57) ABSTRACT

An ink jet recording head includes a plurality of ink ejection outlets, a first member having a plurality of grooves in fluid communication with the ejection outlets, respectively, a second member having a plurality of energy generating elements for producing energy for ejecting ink in the grooves through the ejection outlets, and a clamping unit for clamping the first member with the second member to constitute ink passages with the grooves, wherein the clamping unit has a plurality of pressure regulating mechanism pressure regulating mechanisms, which are independently operable.

11 Claims, 17 Drawing Sheets

U.S. PATENT DOCUMENTS

| | | | |
|---|---|---|---|
| 5,208,604 | 5/1993 | Watanabe et al. | 346/1.1 |
| 5,243,755 | 9/1993 | Inaba et al. | 29/890.1 |
| 5,257,043 | 10/1993 | Kneezel | 346/140 R |
| 5,262,802 | 11/1993 | Karita et al. | 346/140 R |
| 5,281,980 | 1/1994 | Kishida et al. | 346/140 R |
| 5,343,227 | 8/1994 | Hirosawa et al. | 349/42 |
| 5,361,087 | 11/1994 | Tajima et al. | 347/44 |
| 5,365,255 | 11/1994 | Inoue et al. | 347/45 |
| 5,371,528 | 12/1994 | Izumida et al. | 347/87 |
| 5,373,633 | 12/1994 | Satoi et al. | 29/890.1 |
| 5,389,957 | 2/1995 | Kimura et al. | 347/20 |

INK JET RECORDING APPARATUS

CROSS-REFERENCE TO RELATED APPLICATION

This application is a continuation of Application Ser. No. 08/398,942, filed on Mar. 2, 1995, now abandoned.

FIELD OF THE INVENTION AND RELATED ART

The present invention relates to an ink jet recording apparatus, an ink jet recording head and an ink jet recording head manufacturing method, in which liquid droplets are ejected through ejection outlet to effect printing.

In a recording apparatus such as a printer, copying machine, facsimile machine or the like, an image consisting of dots is recorded on a recording material such as paper, plastic resin thin sheet, cloth or the like.

The recording apparatus can be classified into an ink jet type, a wire dot type, a thermal type, an electrophotographic type and the like. Among them, the ink jet type (ink jet recording apparatus) ejects the recording liquid through the ejection outlets of an ink jet recording head to the recording material. Among various types of ink jet method, the type using thermal energy is advantageous in that the responsivity to the recording signal is high and in that the ejection outlets can be manufactured at high density.

Recently, the amount of data to be recorded is increased, more particularly, graphic patterns or the like are printed with the result of the greater amount of data to be printed, so that even higher high speed recording is desired.

An ink jet recording apparatus of the above-described type and of a so-called full line type having a long ink jet recording head having ejection outlets over the recording material width, is expected as increasing the recording speed.

Referring first to FIG. 10, there is schematically shown an example of a conventional ink jet head.

As shown in FIG. 10, it is elongated to cover a length of a side of A4 size recording sheet (full-line type).

In this Figure, designated by a reference numeral 100 is a heater board of Si or the like. On top of this, there are provided electrothermal transducers functioning as ejection energy generating elements and electrode wiring (not shown) for supplying the electric power thereto. Designated by 200 is a top plate of glass or metal or the like. It has a recess manufactured by machining or etching or the like to constitute an ink inlet 209 for receiving recording liquid such as ink, and a common liquid chamber in fluid communication with respective ink passages and with the ink receiving port 209.

Each ink passage is provided corresponding to the ejection energy generating element on the heater board 100. The top plate is bonded on the heater board 100, and the heater board 100 is bonded and fixed on the base plate 300. A confining member 500 functions to connecting and fixing the top plate 200 and the heater board 100. It is threaded on the base plate 300 through the wiring board 400. On top of the confining member 500, an end of a confining spring 600 is fixed by a screw. The other end thereof is contacted to the top surface of the top plate 200 to elastically press the top plate 200. By doing so, the top plate 200 can be mechanically urged to the heater board 1.

With this structure, if the top plate involves warping or deformation, it is not possible to press the top plate following the warping or deformation, with the result of non-uniform urging force by the confining spring in the direction of the length. If this occurs, gap may be formed between adjacent passages. In the ink jet head of this type, there is a possibility that the pressure wave upon ejecting the recording liquid may be transmitted to the adjacent ink passages with the result of cross-torque. If this occurs, non-uniformity occurs on the recorded image, and in addition, ejection failure may occur as a result of the reduction of the ejection speed. Japanese Laid-Open Patent Application No. 126943/1994 proposes comb-like confining spring to make the spring urging force uniform.

However, when the top plate is to be pressed, it is necessary to correctly align the heater board and the top plate so that the ink passages correspond to the associated ejection energy generating element, respectively. However, with this structure, when the confining spring is mounted before the top plate is mounted, the confining spring is present at a part of the place to be taken by the top plate, and therefore, it is not possible to align and connect the top plate after the confining spring is fixed. For this reason, the confining spring is mounted after the top plate is aligned. In this case, however, if the fixing of the confining spring is executed partially, the fixed portion (screw portion) involves concentrated force with the result of the liability of the deformation of the spring, because the urging force by the confining spring is several tens kg in total. Therefore, the uniform urging is difficult. Therefore, in order to apply the uniform urging force by the confining spring, the fixing of the confining spring has to be uniform. In this case, a very bulky apparatus is required with the result of increase manufacturing cost.

SUMMARY OF THE INVENTION

Accordingly, it is a principal object of the present invention to provide an ink jet recording head, an ink jet recording head manufacturing method, and an ink jet recording apparatus, wherein assembling is easy, and a manufacturing apparatus can be downsized and simplified.

According to an aspect of present invention, a mechanism is provided to maintain the released and actuated states of the pressure, thus permitting easy manufacturing, small size and simplified manufacturing apparatus, easiness in the assembling and low manufacturing cost.

In another aspect of the present invention, the pressure can be applied in divided manner, and therefore, the adjustment of the magnitude, order and the load distribution in a direction in which the ejection outlet are arranged, are enabled to assure the connection.

According to an aspect of the present invention, there is provided a ink jet recording head comprising: a plurality of ink ejection outlets; a first member having a plurality of grooves in fluid communication with said ejection outlets, respectively; a second member having a plurality of energy generating elements for producing energy for ejecting ink in said grooves through said ejection outlets; and a clamping unit for clamping said first member with said second member to constitute ink passages with said grooves, wherein said clamping unit has a plurality of pressure regulating mechanisms, which are independently operable.

According to another aspect of the present invention, there is provided an ink jet recording head comprising a plurality of ink ejection outlets; a first member having a plurality of grooves in fluid communication with said ejection outlets, respectively; a second member having a plurality of energy generating elements for producing energy for ejecting ink in said grooves through said ejection outlets;

and a clamping unit for clamping said first member with said second member to constitute ink passages with said grooves, wherein said clamping unit has a leaf spring member divided into a plurality of urging sections by slits, each section having a through openings, and a spring supporting member for supporting said spring member along an array of said ejection outlets, wherein a pressure regulating mechanism is provided for said urging sections.

According to a further aspect, there is provided a manufacturing method for manufacturing an ink jet recording head including a plurality of ink ejection outlets; a first member having a plurality of grooves in fluid communication with said ejection outlets, respectively; a second member having a plurality of energy generating elements for producing energy for ejecting ink in said grooves through said ejection outlets; and a clamping unit for clamping said first member with said second member to constitute ink passages with said grooves, said method comprising the steps of: connecting said clamping unit to said supporting member, wherein said clamping unit has a leaf spring member divided into a plurality of urging sections by slits, each section having a through openings, and a spring supporting member for supporting said spring member along an array of said ejection outlets, wherein a pressure regulating mechanism is provided for said urging sections; regulating pressures of said urging sections; connecting said first member to said second member after said regulating step; releasing the pressure to permit clamping between said first member and said second member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the invention will be described.

Figure 1:
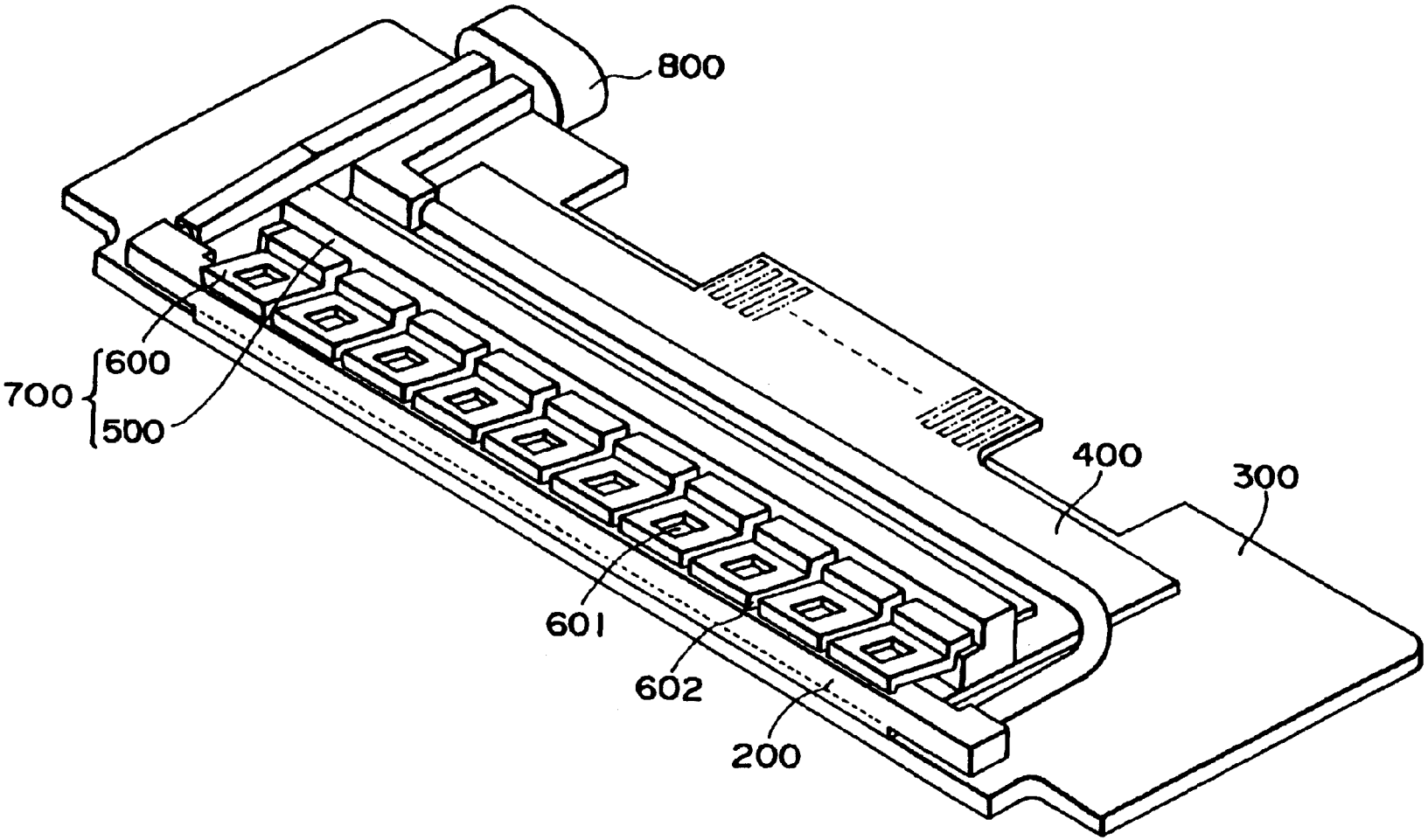
FIG. 1 is a schematic perspective view of an ink jet recording head according to a first embodiment of the present invention.
Figure 2:
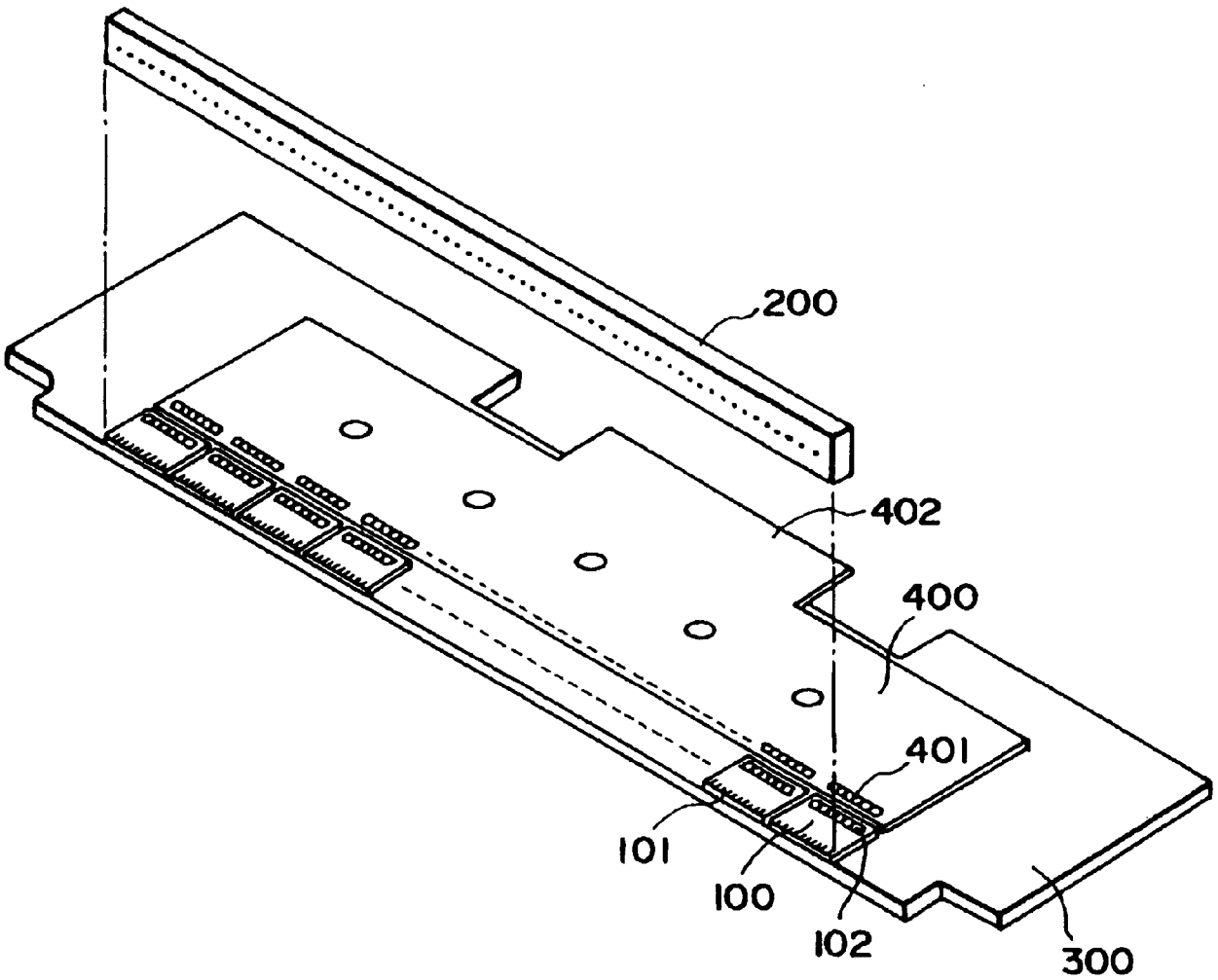
FIG. 2 is a schematic perspective view of the ink jet recording head according to the first embodiment of the present invention.

Referring to FIGS. 1 and 2, there are shown an ink jet recording head for a first embodiment of the present invention. In this embodiment, ink ejection outlets are arranged at a density of 360 dpi (70.5 $\mu$m).

In FIG. 2, a heater board 100 is provided with 128 ejection energy generating elements 101 at the density of 360 dpi. It is provided with signal pads for driving the ejection energy generating elements 101 at proper timing by external electric signals and pads 102 for receiving electric energy for the driving.

The heater board 100 is bonded and fixed on the surface of a base plate 300, and is of metal or ceramic material.

Figure 3:
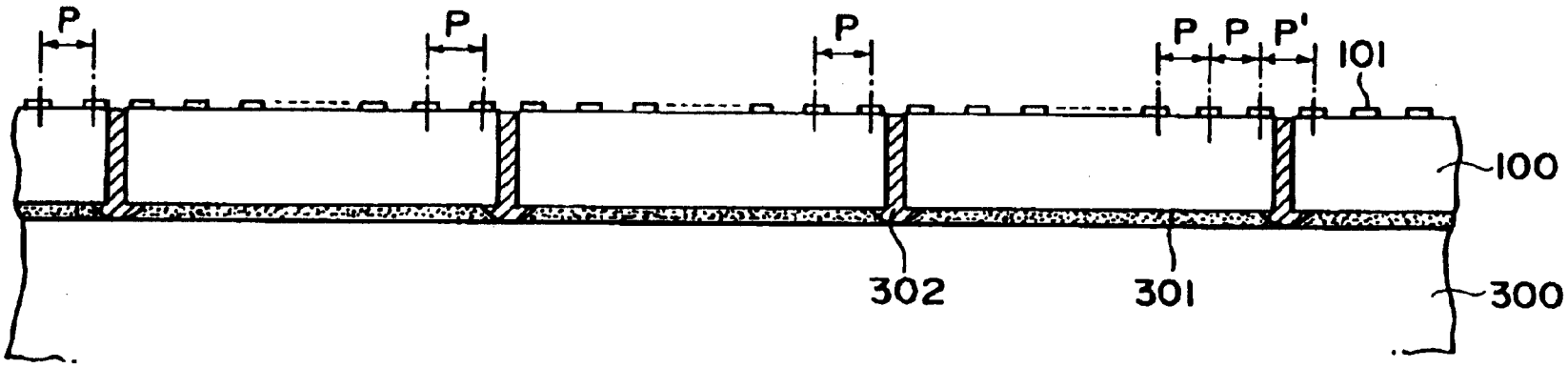
FIG. 3 is a schematic view illustrating arrangement of the heater board in the first embodiment.
Figure 4A:
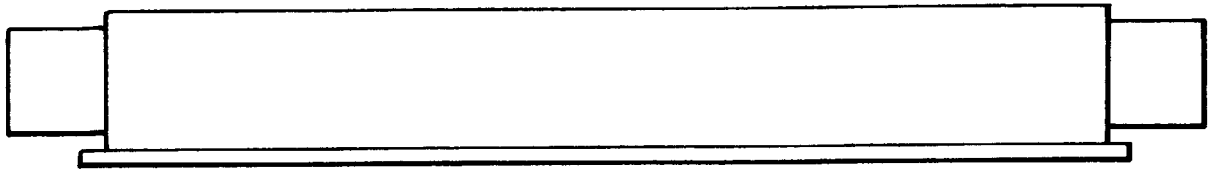
FIGS. 4(*a*) through 4(*d*) are schematic views of a top plate of an ink jet recording head according to the first embodiment.
Figure 4B:
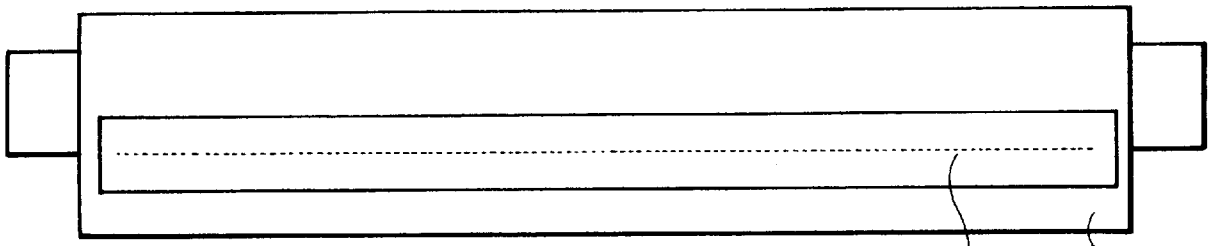
Figure 4C:
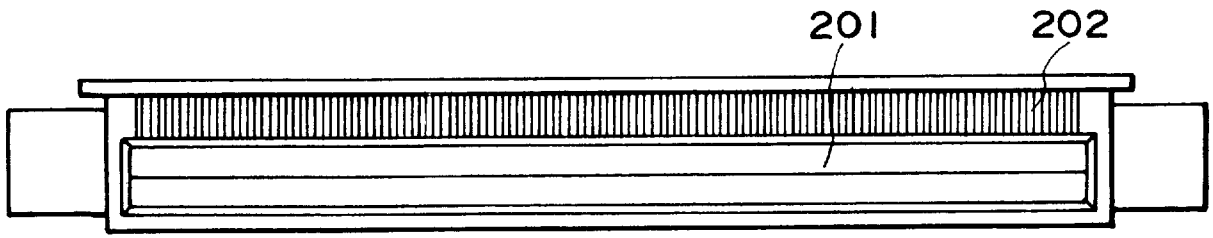
Figure 4D:
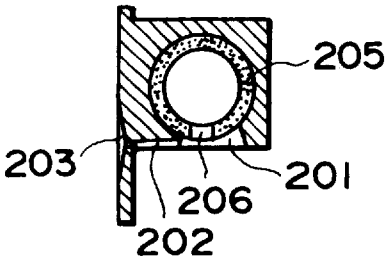

FIG. 3 illustrates the heater board 100 on the base plate 300. A plurality of heater board 100 per mounted on the base plate 300, and are bonded and fixed by a predetermined thickness of adhesive material 301 at predetermined positions on the base plate 300. The heater board is provided such that the intervals between adjacent ejection energy generating elements at an end of the heater board are the same as the intervals of 70.5 $\mu$m at which the ejection energy generating elements 101 are arranged. The gaps between the heater boards occurring at this time, are sealed by a sealant 302. The heater board 100 is not limited to the one described above, but one integral heater board is usable.

Referring back to FIG. 2, the base plate 300 has a wiring board 400 bonded in the similar manner as in the heater board 100. The plurality of pads 102 on the heater board 100 and a plurality of pads 401 on the wiring board 400 for supplying the signal and electric energy, are made in a predetermined corresponding relation. The wiring board 400 is provided with a connection 402 for supplying external printing signals or driving electric energy.

Referring to FIGS. 4(*a–c*) the top plate 200 will be described. In FIGS. 4(*a–c*) the top plate 200 is provided with a plurality of passages 202 corresponding to the ejection energy generating elements 100 on the heater board 100, orifices 203 in fluid communication with the corresponding passages 202, respectively, to eject the ink toward the recording material, a liquid chamber 201 connected with each of the passages 202 for supplying the ink to the liquid passages 202, an ink supply tube for constituting an ink supply passage for supplying the ink from an ink container (not shown) to the liquid chamber 201, an ink supply port 206 for supplying the ink to the liquid chamber through the ink supply tube 205. The top plate 200 has a length substantially covering the array of the ejection energy generating elements constituted by arranging a plurality of heater boards.

Referring back to FIG. 1, the top plate 200 is connected such that the positional relationships between the passages 202 and the ejection energy generating elements 101 on the heater board on the base plate 300, have the predetermined corresponding relationships.

The method of connecting them is mechanical clamping using springs or the like.

In FIG. 1, a clamping unit 700 for clamping the top plate and the heater board with each other comprises a leaf spring member 600 and a spring fixing member 500 for fixing the leaf spring member.

Figure 5A:
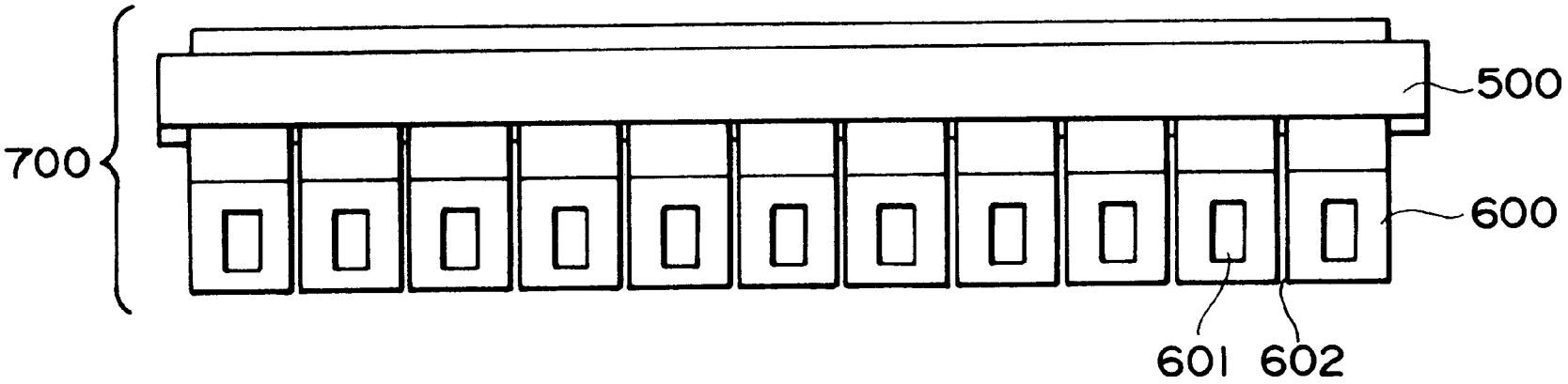
FIGS. 5(*a*) and 5(*b*) illustrate a top plan view of a cross-sectional view of a clamping unit according to the first embodiment.
Figure 5B:
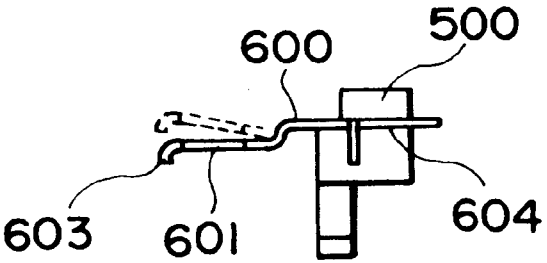

FIGS. 5(*a*) and 5(*b*) are a top plan view and a sectional view of the clamping unit. The leaf spring member 600 is of phosphor bronze, stainless steel or the like, and it is in the form of an integral leaf spring provided with slits 602. The portions of the leaf spring divided by the slits 602 constitute the urging portion for urging the top plate. The urging portion is provided with a bent portion to increase the spring rigidity for each urging portion. At an end of the bent portion there is provided a through opening 601. The end of the leaf spring adjacent the urging side, has aprons 603 bent downward to effectively urge the top plate 200, at the end of the leaf spring. The free ends of the aprons are machined into an acute angle so that the contact or urging portion to the top plate is within the upper part of the ink passage. By the concentrated urging to the ink passage portion, the ink passage walls between the neighborhood of the ejection outlet and the heat generating portion, which is most influential to the cross-talk, can be assuredly urged to the heater board.

The through openings 601 are effective to permit insertion of a tool for regulating the urging force and also to be an inlet for a sealant for sealing the top plate and the wire bonding portion. The sealing of the top plate is effected after it is fixed using the clamping unit. In this case, if the sealant is supplied from the opposite ends of the long top plate, the sealant does not extend enough. In view of this, the sealant is injected through the openings provided for the respective urging portions. The front end of the through opening is preferably close to the election outlet to provide enough stroke of the spring. More particularly, it is preferably disposed to correspond to a front half region from the center of the depth of the top plate. In addition, the rear end of the through opening is preferably close to the ejection outlet under the condition that the wire bonding portion can be seen therethrough, since then the sealing can be assuredly effected without reducing the spring rigidity.

The apron is effective to provide space between the leaf spring and the top plate, and the tool is received by the space. The length of the apron is determined in consideration of the strength of the tool and the rigidity of the spring.

According to this embodiment, the integral leaf spring is used, so that the position of the urging can be correctly aligned for the respective urging portions, and in addition, the width of the slit can be reduced.

A spring fixing member 500 for supporting the leaf spring 600 is of resin material such as PPS, and is integrally formed with the leaf spring member 600 through insert molding or the like. At this time, in order to reinforce the fixing portion of the leaf spring, the integral formed portion of the leaf spring is provided with a through bore 604, as shown in FIG. 5(*b*). The leaf spring is bent at this portion. The rear end of the leaf spring member is projected through the spring supporting member. The tool is hooked to the rear end of the leaf spring member, so that the urging force can be regulated by the leaf spring member and the spring fixing member only. The clamping unit 700 is fixed on the base plate 300 by crimping or screws or the like to clamp the top plate 200 and the heater board 100 by the urging force of the leaf spring member 600. The urging force at this time is 0.2–0.4 kg/mm in this embodiment, although it is dependent on the rigidity of the top plate 200. Therefore, in the case of the full line head, the urging force for the entire length, is as large as several tens kg. It is preferable that the slits are provided such that the urging forces of the respective urging portions are 4–5 kg. In this embodiment, the slits are provided such that the urging portions of the leaf spring member correspond to the respective heater boards.

The clamping unit is provided with a mechanism for permitting regulating and releasing the urging force for the respective urging portions.

Figure 6:
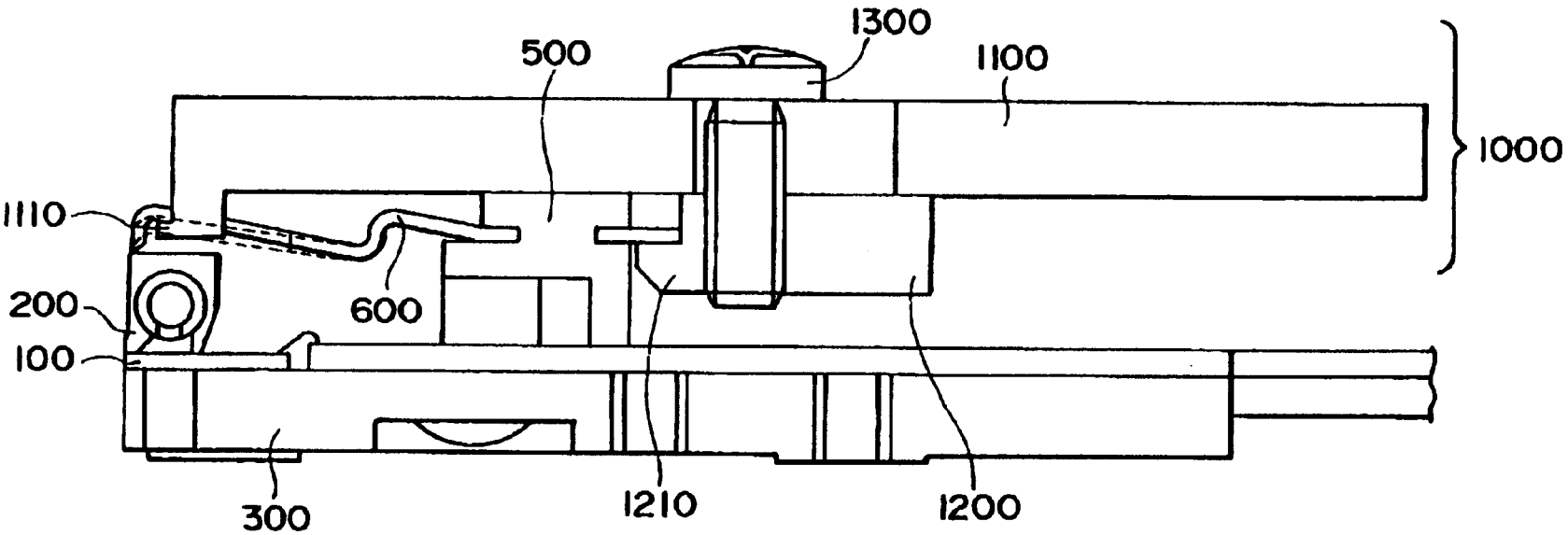
FIG. 6 illustrates an urging force regulating mechanism for the clamping unit in the first embodiment.

FIG. 6 illustrates the urging force regulating mechanism of the clamping unit.

In FIG. 6, the clamping unit is provided with a tool 1000 for regulating the urging force, a first engaging portion 1110 in the tool 1000. The first engaging portion 1110 is inserted into a through opening 601 of the leaf spring member 601, and is engaged with the end of the leaf spring 600. A second engaging portion 1210 of the tool 1000 is engaged to the rear end of the fixing portion of the spring fixing member 500. Designated by 1300 is a screw for connecting a first member 1100 having the first engaging portion 1110 and a second member 1200 having the second engaging portion 1210.

The tool 1000 is in the form of a lever with the fulcrum at the portion contacting the spring confining member 500 and with a operating point of the first engaging portion. By lowering the rear end of the first member, the urging force of the leaf spring urging portion can be regulated. With this state maintained, the screw 1300 is fixed to fix the position of the urging portion at the upper portion. When the top plate 200 is connected with the heater board 100, all of the urging portions of the leaf spring member 600 are fixed at the upper portion as described above, and in this state, the top plate 200 is mounted. After the completion of the alignment of the top plate 200, the tool 100 is removed in the reversed order, by which the urging force of the urging force is released so that the top plate 200 is fixed.

As described above, by the use of the urging force regulating tool, the regulation and release of the urging force can be easily carried out between the top plate 200 and the heater board 100.

By disposing a leaf spring member between the top plate and the leaf spring, it is possible to independently adjust the respective urging forces of the urging portions so that better clamped state is provided. By effecting the regulation and release of the urging force using the removable tool, the unit can be downsized, and the durability and operativity are improved.

A manufacturing method of the ink jet recording head will be described in conjunction with FIG. 7.

Figure 7:
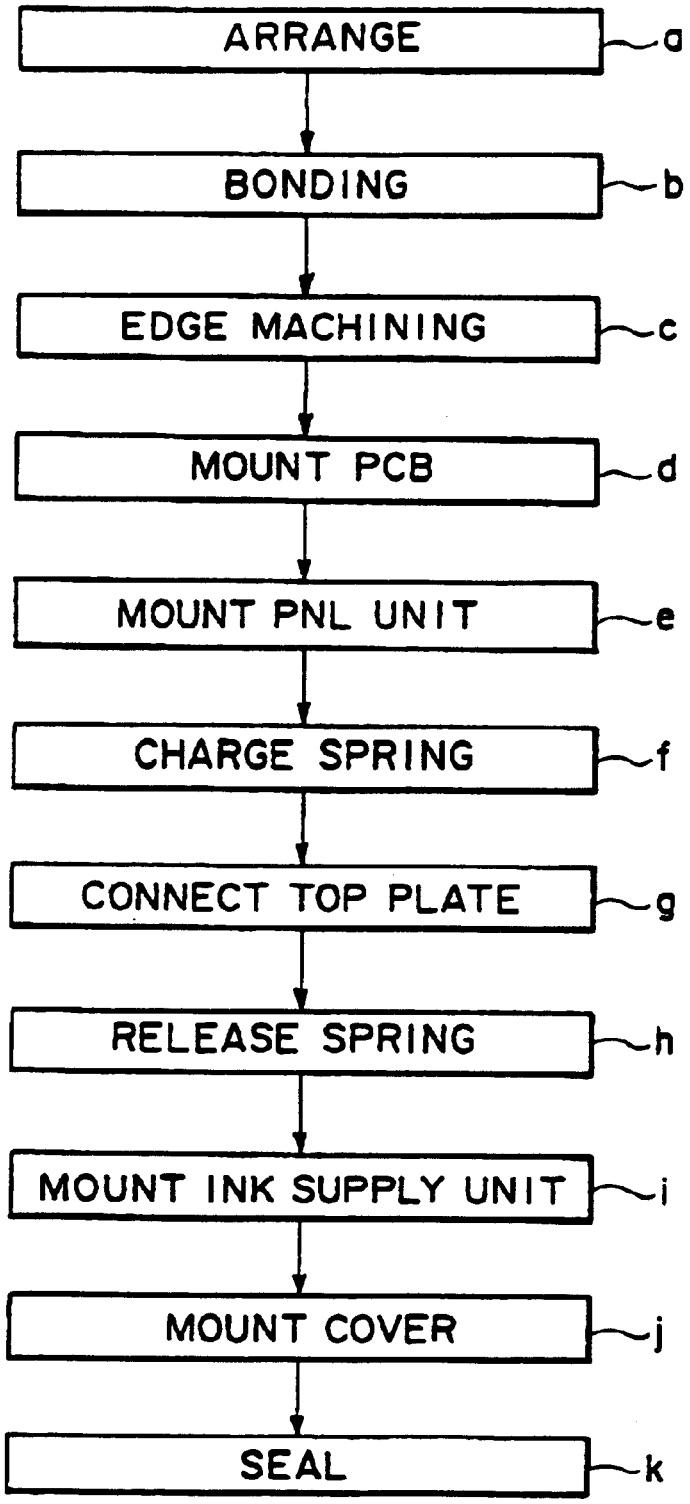
FIG. 7 illustrates a manufacturing steps for an ink jet recording head, according to the first embodiment.

FIG. 7 shows the manufacturing steps for the ink jet head. In this embodiment, the elongated multi-nozzle head comprises 11 heater boards (HB) and one grooved top plate.

Figure 8:
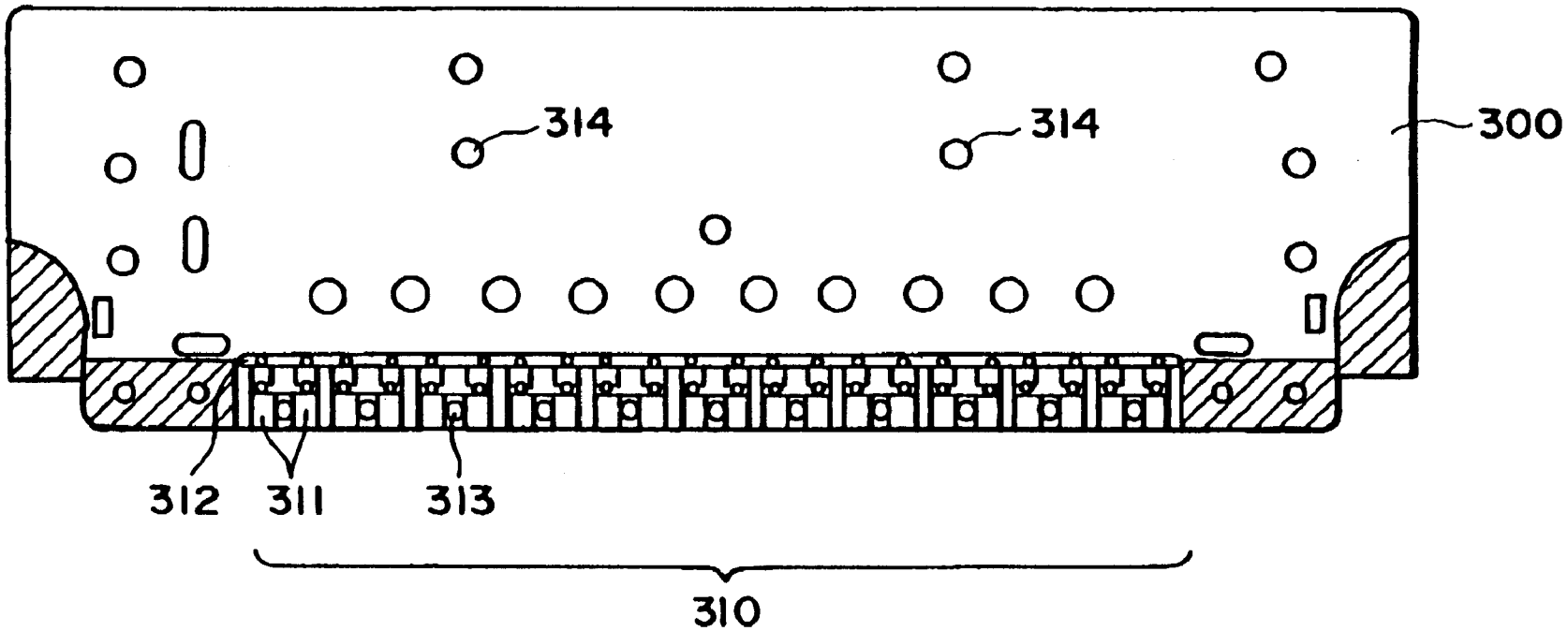
FIG. 8 is a schematic view of a base plate of an ink jet head according to the first embodiment.

First, an aluminum base plate is manufactured through die cast molding to provide a base plate having a heater board support and PCB positioning projections. The supporting portion is provided with an opening for sucking air for the purpose of temporarily fixing a recess for the bonding material ejection and the heater board. FIG. 8 schematically shows a base plate die which has been cast molded. In this Figure, it comprises a heater board support 310, a recess 311 in the heater board supporting portion, an adhesive injection groove 312 in communication with the recess, a sucking opening 313, and a positioning projection 314 for the PCB.

The hatched portion and the surface of the supporting portion of the base plate are abraded to increase the surface property of the supporting portion, thus reducing the error in the mounting of the heater board. The end portions of the base plate function as the positioning portion for the apparatus, so that the manufacturing accuracy of the apparatus can be improved.

On the other hand, a plurality of heater boards (HB) have the electrothermal transducer elements through a thin film forming technique on a silicon substrate.

Subsequently, the plurality of the heater boards are positioned with high precision using a positioning tool onto the heater board supporting portion of the base plate. The heater board thus correctly positioned is temporarily fixed by sucking the air through the opening by a vacuum system disposed below BP. In this manner, the heater boards are sequentially positioned on the base plate (step a).

The adhesive material is supplied through the injection groove of the base plate. The adhesive material extends to the respective recesses in communication with the adhesive injection grooves by capillary force. Thereafter, it is left for a predetermined period to dry the bonding material, by which the heater board is completely secured. Thereafter, the vacuum sucking is stopped. If further strong securing is desired, the adhesive material may be injected through the sucking opening (step b).

After the completion of the arrangement and fixing of the heater board, the base plate and the heater board are machined to remove the step at the ejection side end of the heater board. By doing so, the top plate is abutted to the ejection side end of the heater board, as will be described hereinafter, and the edge machining step is effective to avoid the crosstalk (step c).

Subsequently, PCB (wiring board) is bonded to the base plate with the correct positioning using the positioning projections described hereinbefore. By doing so, the electrode pads on the PCB and the electrode pads on the heater board are aligned with a predetermined positional relationship. Then, the electrode pad of the PCB and the electrode pad on the heater board are electrically connected by wire bonding. In this step, the electroconductivity of the wire bonding is checked (step d).

Subsequently, a clamping unit for contacting the top plate to the heater board on the BP (Base plate), is mounted. The clamping unit comprises a leaf spring member for urging the top plate to the heater board and a spring supporting member for supporting the leaf spring. The leaf spring has a plurality of slits to provide a plurality of divided urging portions. Each urging portion is provided with a through opening, through which a tool is inserted to regulate and release the urging force for the urging portions.

When the clamping unit is fixed to the PCB, a fixing member for the clamping unit is connected to BP (Base plate) through the PCB, and it may be fixed by screws or thermal crimp (step e).

In order to connect the top plate to the heater board, the urging forces of the urging portions are regulated by the tool (step f).

After sufficient space is assured on the heater board, the alignment operation is carried out between the ink passages and the ejection energy generating elements, and the top plate is connected with the heater board (step g).

By releasing the urging force of the urging portion, the top plate is securedly fixed. In the releasing step, the urging force is released from the central portion toward the end portions. By doing so, the warp of the top plate can be corrected, and the deformation escapes toward the other side, by which the satisfactory clamping is assured over the entire length of the heater board. After the urging force is released, the tool is removed from the recording head (step h).

The ink supply unit is fixed on the base plate by thermal fusing or the like to the position where the ink supply tube is connected to each end of the top plate. By the ink supply unit, the ink is supplied to the top plate. The ink may be supplied in both directions, or may be supplied one way and the ink is circulated. In the connection portion with the ink supply unit, a filter is provided to trap bubbles (step i).

Finally, a heat cover is mounted to cover the base plate, and a sealing material is injected to the top plate connecting portion and the wire bonding portion through windows provided at positions corresponding to the urging portions of the head cover (steps i and k).

Figure 11:
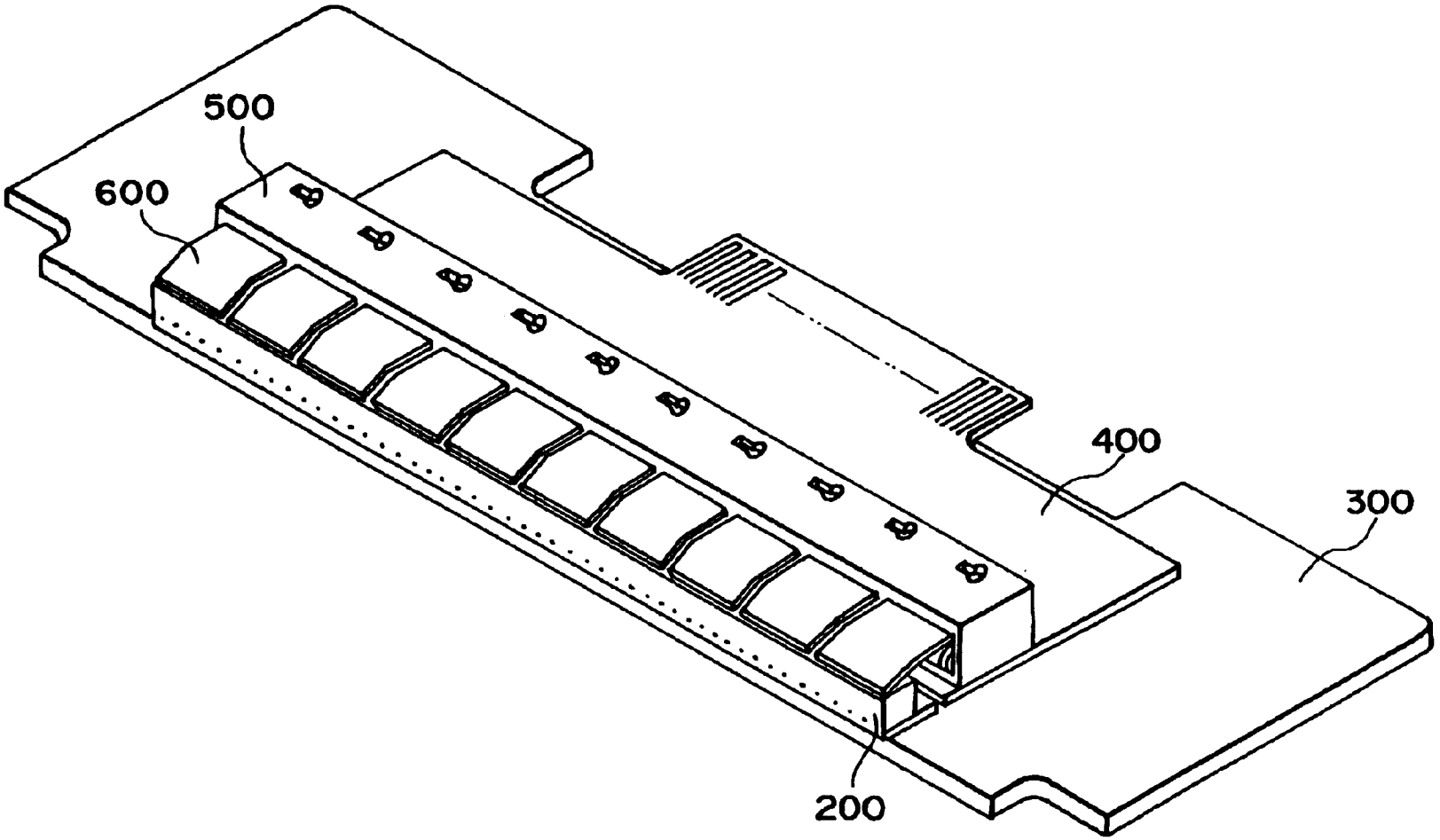
FIG. 11 is a schematic perspective view of an ink jet recording heed according to a second embodiment of the present invention.
Figure 12:
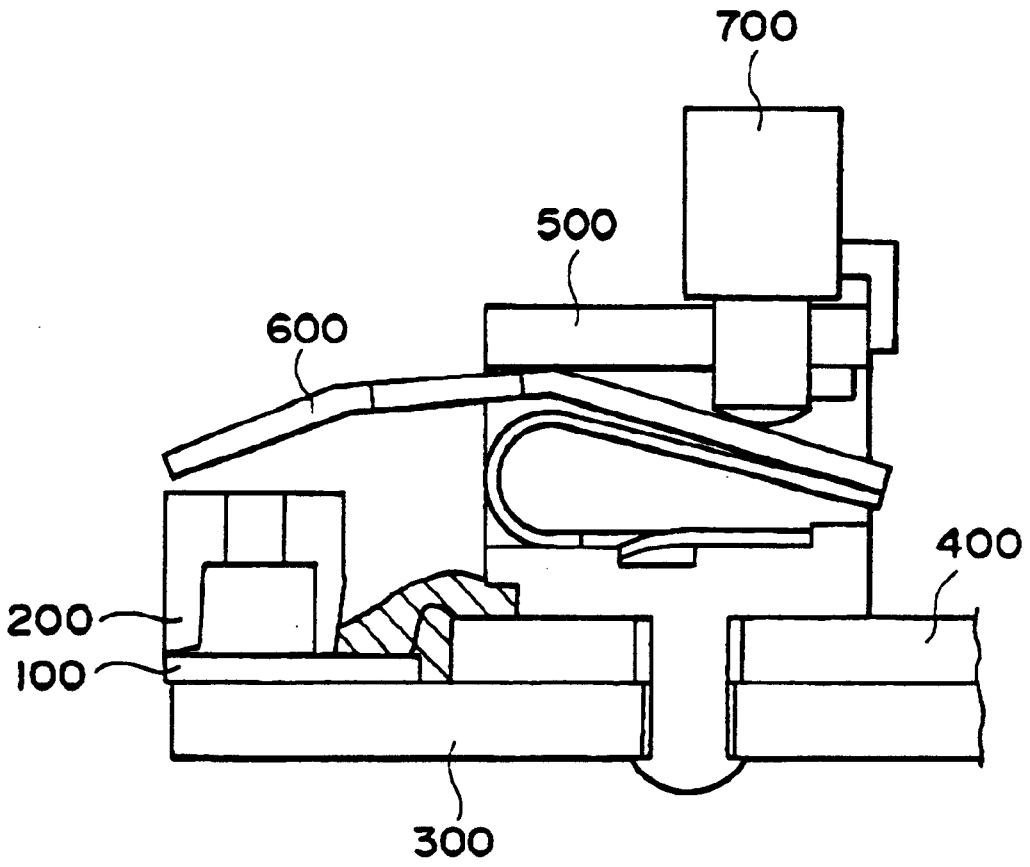
FIG. 12 is a sectional view when the clamping force between the top plate and the heater board are released, in the second embodiment.
Figure 13:
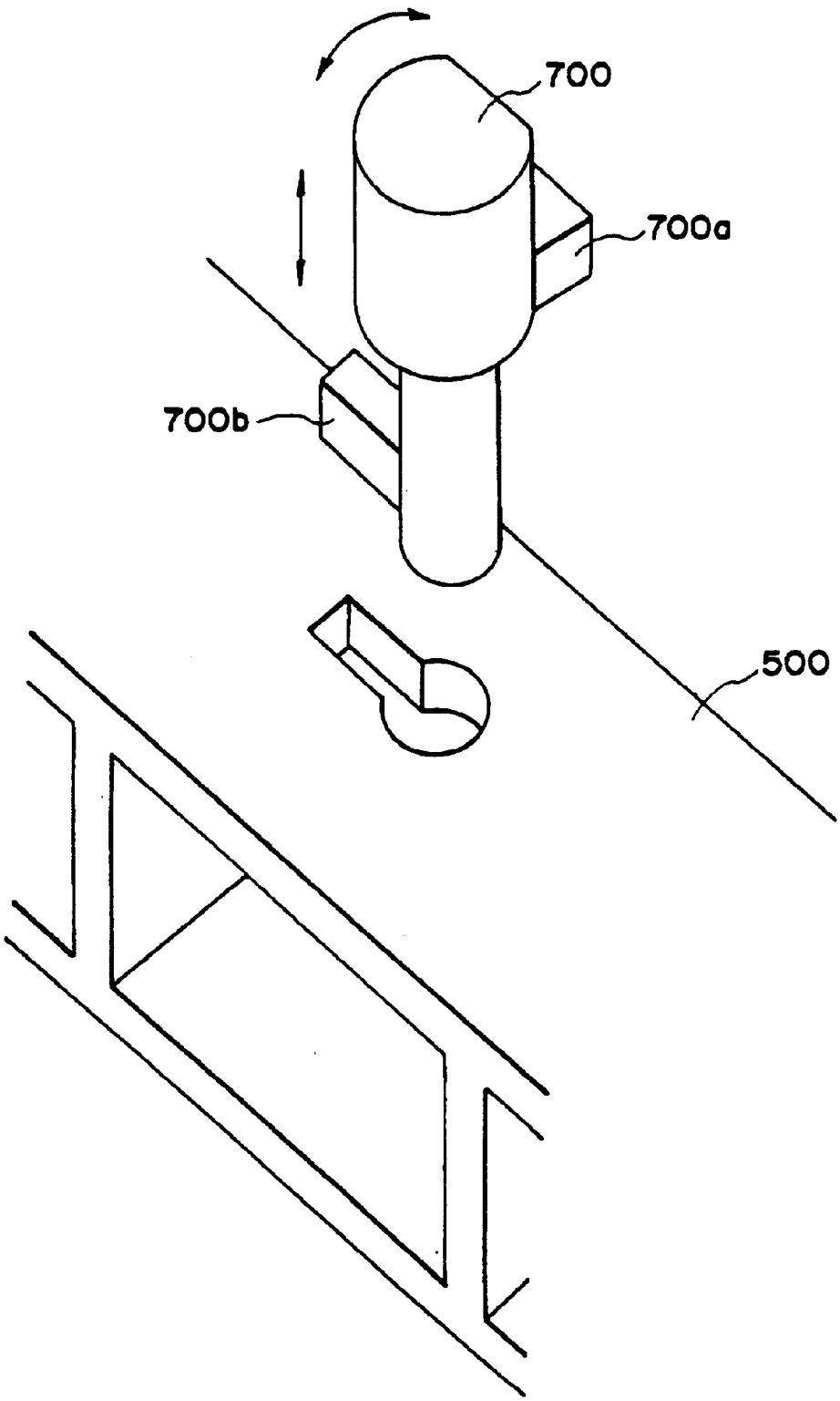
FIG. 13 is a schematic perspective view of a structure of a charge pin according to the second embodiment.
Figure 14:
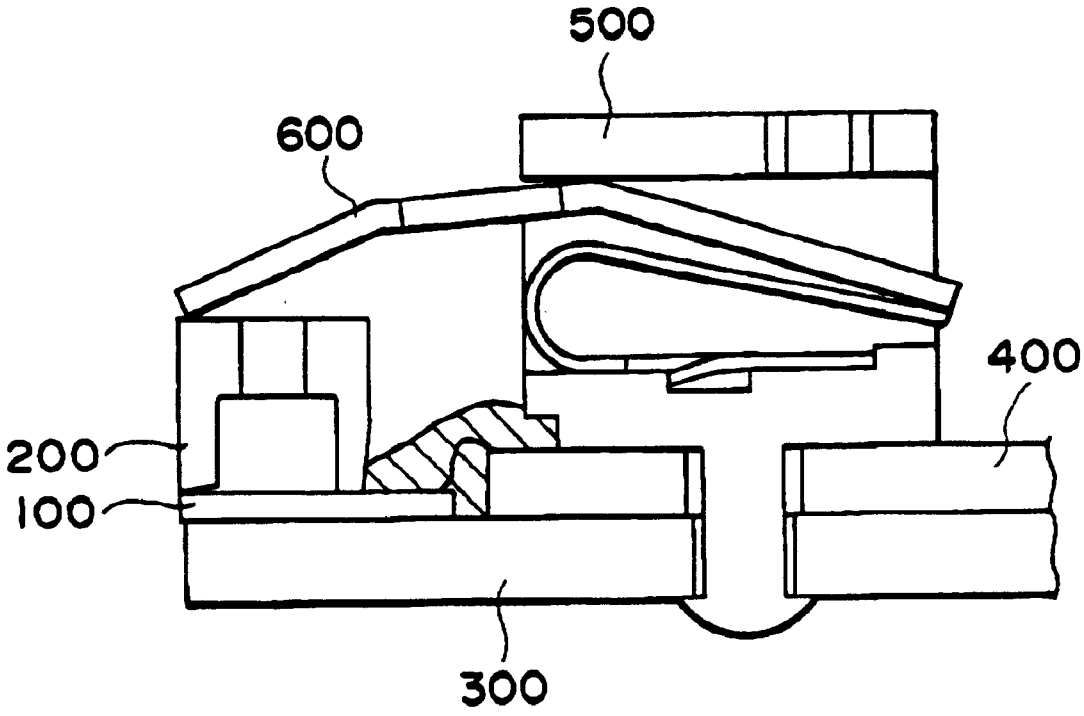
FIG. 14 shows a sectional view (clamped state) of the elements shown in FIG. 11.

Referring to FIGS. 11–14, a second embodiment of the present invention will be described. FIG. 11 is a schematic perspective view of an ink jet recording head according to the second embodiment. FIG. 12 is a sectional view thereof when the pressure between the top plate and the heater board is released. FIG. 13 is a schematic perspective view of a charge pin. FIG. 14 is a sectional view of the elements of FIG. 11. As shown in FIG. 11, a confining spring 600 is mounted on a confining spring unit 500. The confining spring unit 500 is fixed on the base plate 300 by crimping or screws or the like. By the spring force of the confining spring 600, the top plate 200 and the heater board 100 are clamped. The spring force for this purpose is 0.2–0.4 kg/mm, although it is dependent on the rigidity of the top plate 200.

When the top plate 200 is fixed on the base plate 300, urging force producing unit constituted by the confining spring unit 500, the confining spring 600 and the charge pin 700 shown in FIGS. 12 and 13, is used, so that the spring force of the confining spring 600 is not imparted to the top plate 200. The unit for producing the clamping force is provided with a mechanism for releasing the urging force and for maintaining the clamping state.

The confining spring unit 500 is provided with a plurality of through holes in the form of a key hole, as shown in FIG. 11. The confining spring 600, as shown in FIG. 12, a plate-like member bent at two portions and a U-shaped member connected thereto. It is accommodated below the through opening in the confining spring unit 500 so that the plalte-like member is at the top. Only the plate-like member is projected to the outside of the confining spring unit 500 to be capable of urging the top plate 200.

The charge pin 700 is inserted through the through opening in the confining spring unit 500. As shown in FIG. 13, the inserting portion is provided with a locking portion **700*b* for maintaining the state of insertion. In the non-insertion portion, there is provided a stop 700*a* in the form of "L" for rotation control. The stop 700*a* abuts the confining spring unit 500 when the charge pin 700 is rotated, so that the amount of rotation is controlled. In order to determine the direction of the charge pin 700**, a D-cut portion is provided at the top, so that the correct insertion, alignment and rotation are facilitated.

The charge pin 700 of the above structure is inserted into the spring unit 500 and is rotated, and is locked. By this, the contact portion between the plate-like member and the U-shaped member, is changed to raise the end position of the plate-like member functioning as the portion for confining the top plate 200, so that the clamping force to the top plate 200 is released.

When the top plate 200 and the heater board 100 are clamped, the charge pin 700 is inserted into the confining spring unit 500, as shown in FIG. 12, by which the clamping force to the top plate 200 is released. The confining spring unit 500 and the base plate 300 are aligned with each other and are fixed together. Thereafter, the charge pin 700 is rotated in the opposite direction, and is removed. By this, the end of the confining spring 600 is brought into contact with the top plate 200, as shown in FIG. 14, so that the top plate 200 and the heater board are clamped.

As described above, by the operation of the charge pin in the up and down direction and the rotational direction, the top plate 200 and the heater board 100 are clamped or released without difficulty.

In the line type head shown in this embodiment, the total clamping load is as large as several tens of kilograms, and therefore, the division is effected so that the spring force of a spring is 4–5 kg or lower. It is preferable that the clamping is effected from the center toward the ends, since then the top plate follows the warpage or curve or deflection of the base plate so as to provide the satisfactory clamping. Providing a member between the comfining spring and the confining spring unit so as to permit independent adjustment of the respective confining forces is preferable. As in this embodiment, by providing the clamping force controlling member (charging pin) which is mountable and demountable, so that the unit is downsized, and the durability and the operativity are improved.

Figure 15:
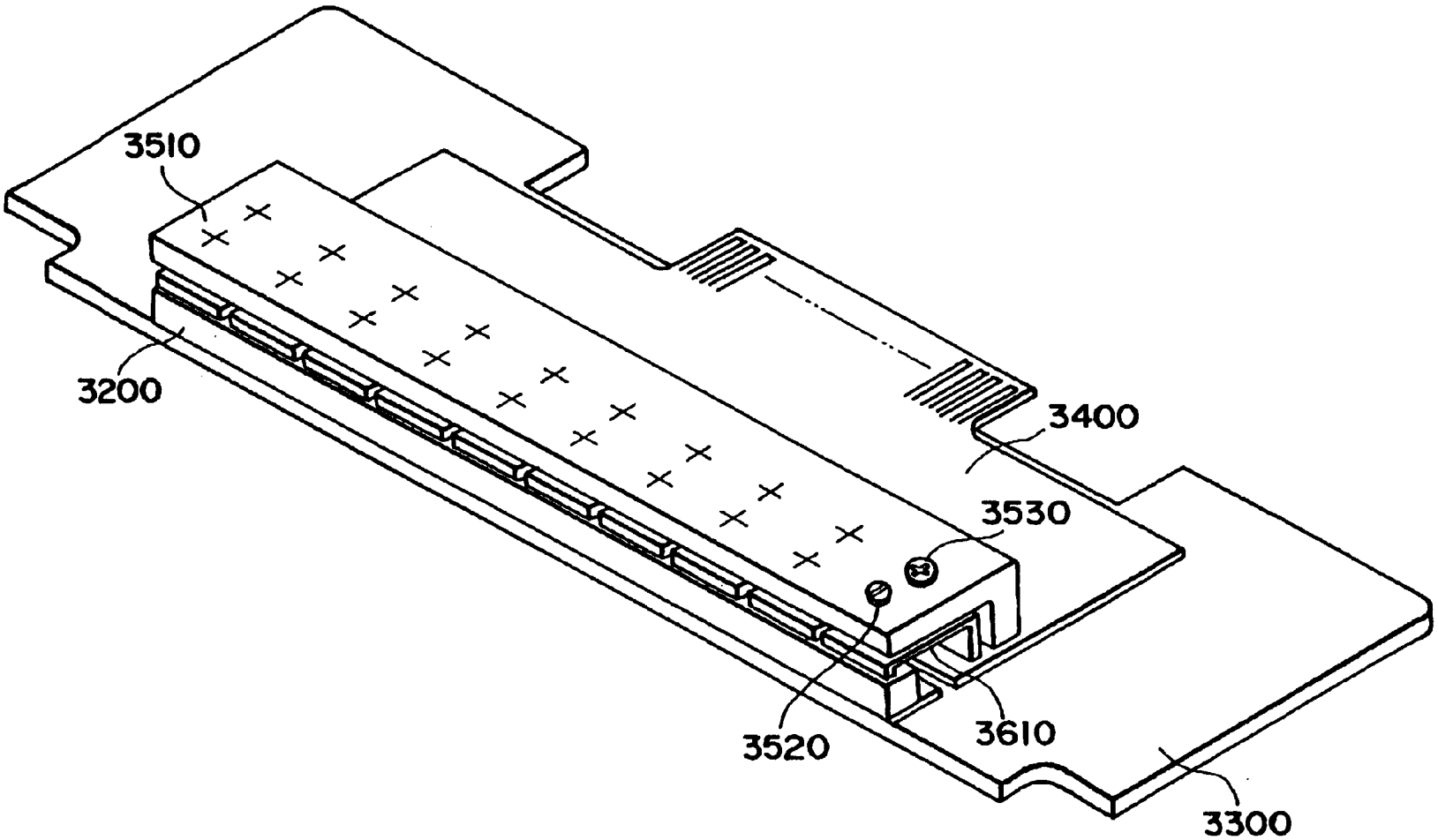
FIG. 15 is a schematic perspective view of an ink Vet recording head according to a third embodiment of the present invention.
Figure 16:
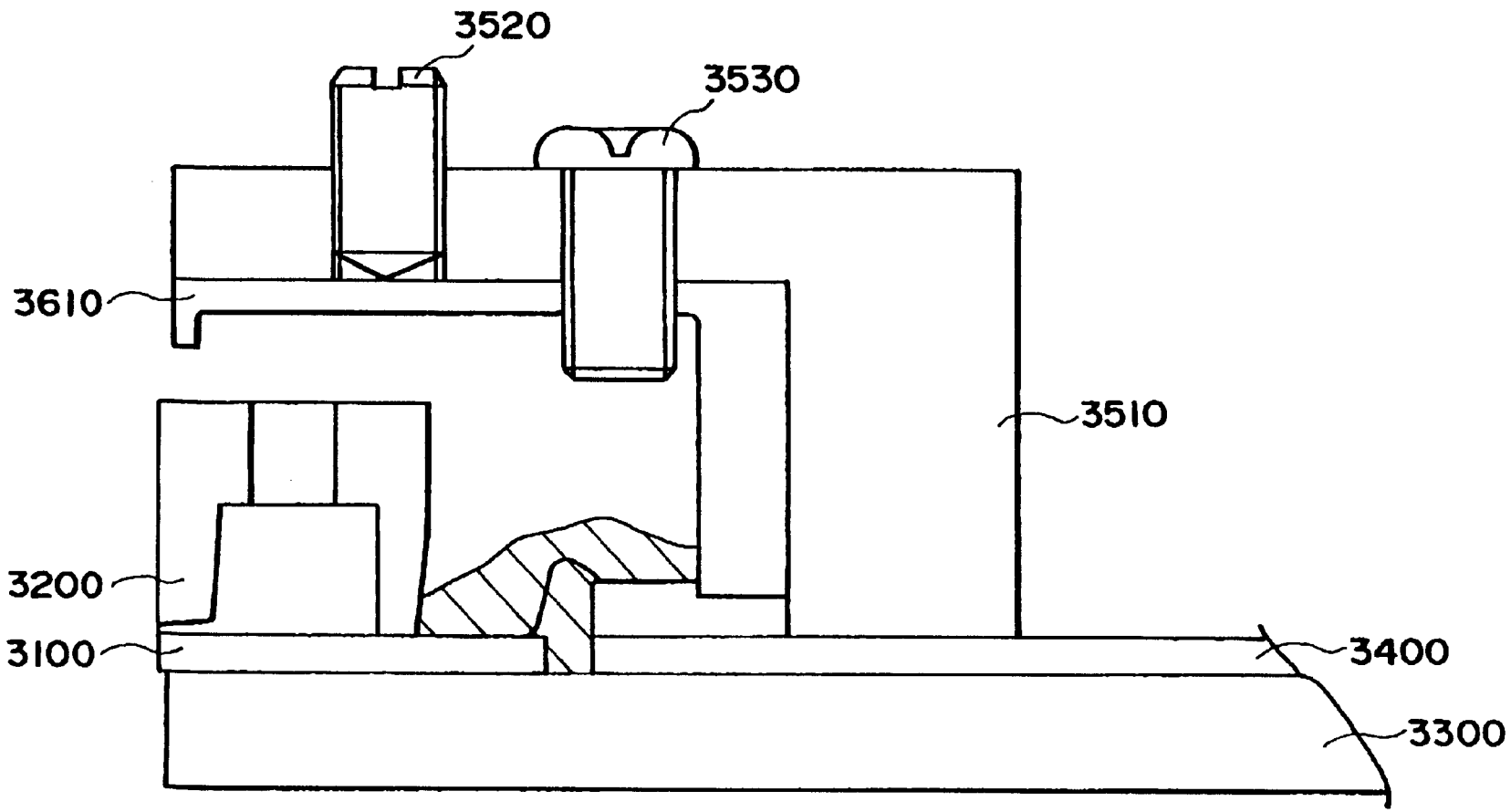
FIG. 16 is a sectional view (released state) of the elements shown in FIG. 15.
Figure 17:
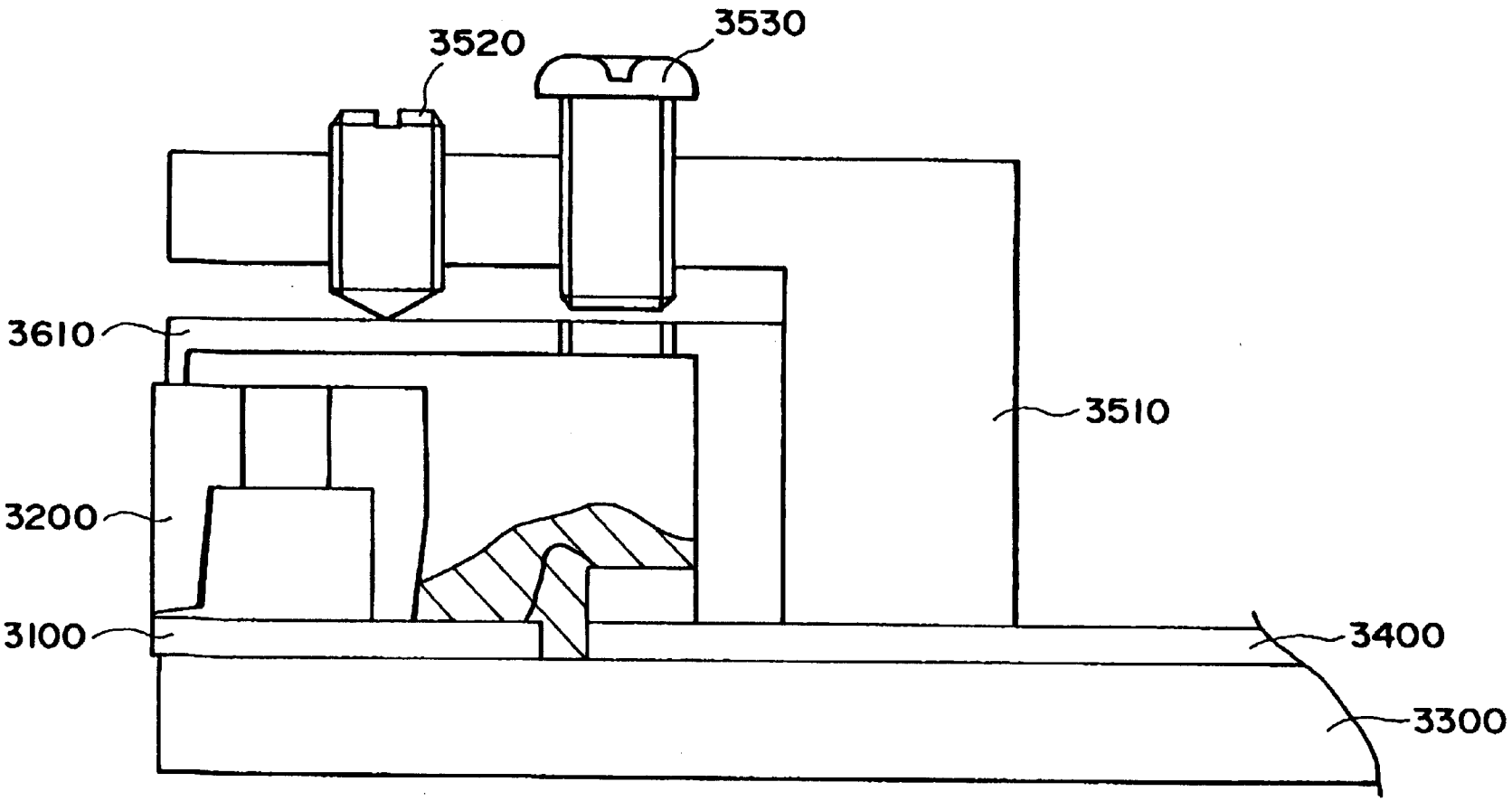
FIG. 17 is a sectional view (clamped state) of the elements shown in FIG. 15.

Referring to FIGS. 15–17, a third embodiment will be described. FIG. 15 is a schematic perspective view of an ink Jet recording head according to a third embodiment of the present invention. FIG. 16 is a sectional view when the top late 3200 and the heater board 3100 are clamped, and FIG. 17 shows them in the released state.

As shown in FIG. 15, a supporting plate 3510 having a L-shaped cross-section, is fixed on the base plate 3300 by crimping or by screws. An L-shaped confining member 3610 is fixed on a wiring board 3400 with its one end as a pivot. The other end (open end) is above the top plate surface. It is urged by in adjusting screw 3520 at the top to transmit the clamping force for between the top plate 3200 and the heater board 3100. The description will be made as to when the urging force released state and the urging force applied state.

As shown in FIG. 16, in the released state (mounting process), it is fixed to the supporting member 3510 by the charging screw 3530.

The adjusting screw 3520 is set so as to avoid abutment to the confining member 3610.

With this state, the charge screw 3530 is rotated to release the threaded state with the confining member 3610 is removed to free the confining member 3610. The end of the confining member 3610 is contacted to the top plate 3200 only by its weight, and therefore, without any clamping force.

By rotating the adjusting screw, as shown in FIG. 17, the confining member 3610 is urged to apply the clamping force between the top plate 3200 and the heater board 3110. The clamping force can be adjusted by controlling the torque of the adjusting screw 3520 and the screw rotational angle or the like.

Thus, only by the control of the adjusting screw, the clamping force between the top plate 3200 and the heater board 3100 can be controlled. Thus, the structure of the apparatus is simple with reduced cost and easy manufacturing.

Figure 9:
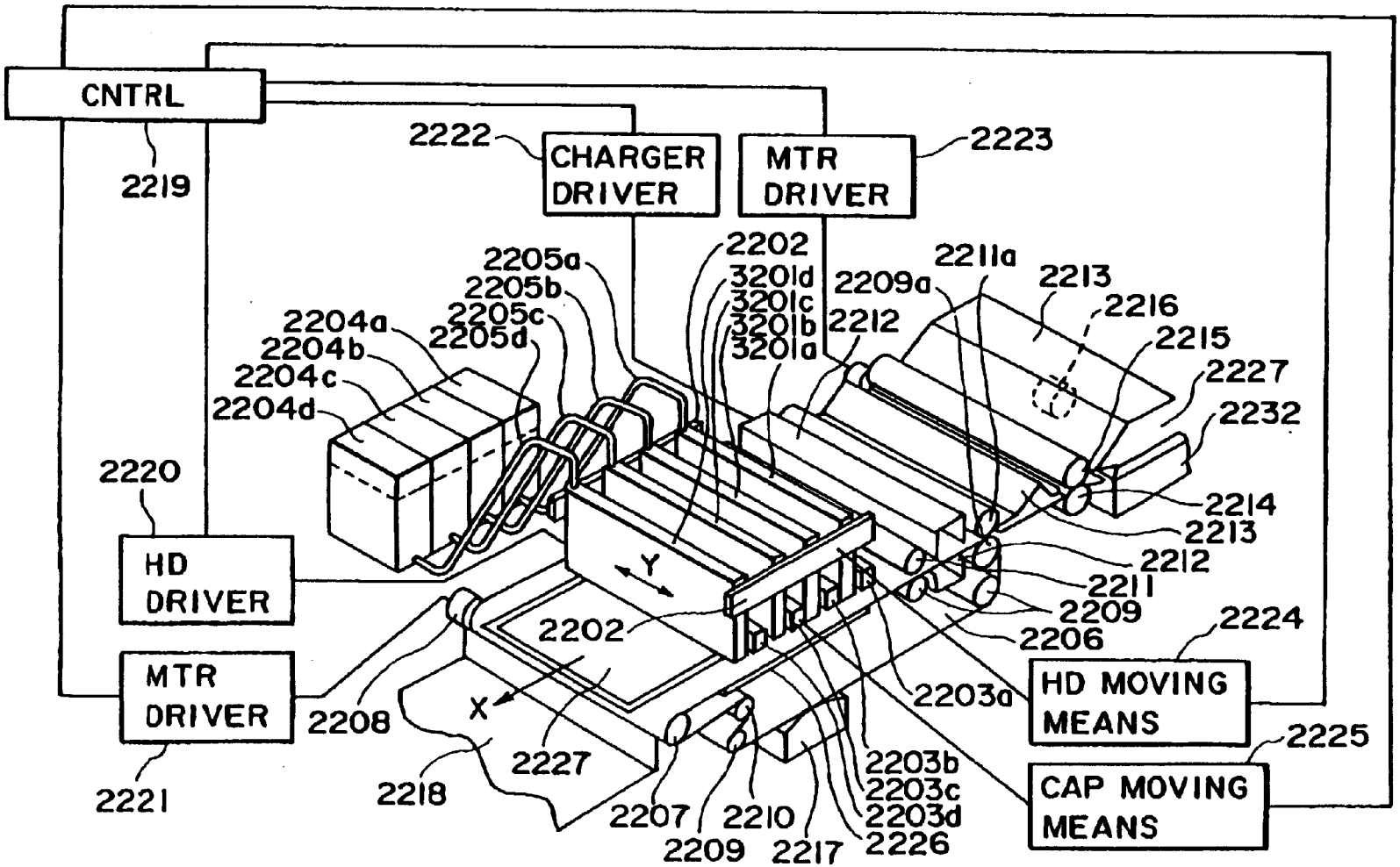
FIG. 9 illustrates an example of an ink jet apparatus using the ink jet head according to an embodiment of the present invention.
Figure 10:
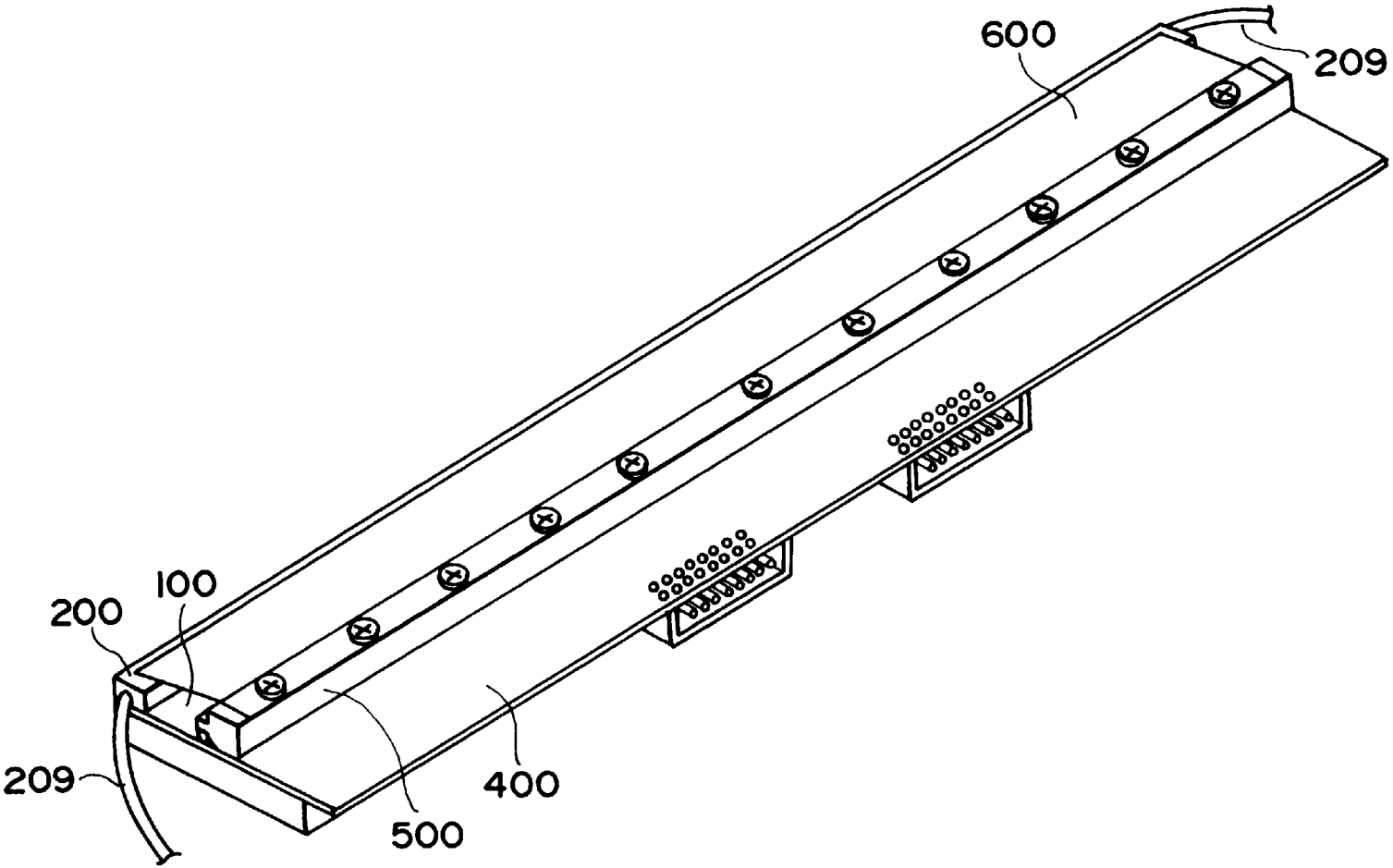
FIG. 10 PRIOR ART
FIG. 10 is a schematic perspective view of an example of a conventional full-line type ink jet head.

FIG. 9 shows an example of an ink jet recording apparatus incorporating the ink jet recording head according to an embodiment of the present invention.

As shown in FIG. 9, the ink jet recording apparatus is provided with line-type heads 2201*a*–2201*d*. The line type heads 2201*a*–2201*d*, are fixed to be extended in parallel with each other with a predetermined gap in X direction by a holder 2202. In the bottom surface of each of the recording heads 2201*a*–2201*d*, 3456 ejection outlets are provided directed downward and arranged in one line at the density of 16 ejection outlets per 1 mm. This permits the recording on the width of 218 mm. Each of the recording heads 2201*a*–2201*d* is a type of using thermal energy, and the ejection is controlled by a head driver 2220.

A head unit is constituted by heads 2201*a*–2201*d* and a holder 202. The head unit is movable up and down by head moving means 224.

Below the heads 2201*a*–2201*d*, head cap 2203*a*–2203*d* are disposed adjacent to each other and corresponding to the associated heads 2201*a*–2201*d*. In the head caps 2203*a*–2203*d*, ink absorbing materials such as sponge material are provided.

The caps 2203*a*–2203*d* are fixed by an unshown holder, and the capping unit includes the holder and the caps 2203*a* and 2203*d*. The cap unit is movable in X direction by a cap moving means 2225. Each of the recording heads 2201*a*–2201*d*, is supplied with either of cyan, magenta, yellow and black color ink through the associated ink supply tube 2205*a*–2205*d* from the associated ink container 2204*a*–2204*d* to permit color recording.

The ink supply uses capillary force of the head ejection outlet, and the liquid surface level in each of the ink containers 2204*a*–2204*d* is lower than a predetermined amount than the ejection outlet position.

The apparatus is provided with an electrically chargeable seamless belt 2204 for carrying a recording sheet 227 (recording material).

The belt is extended through a predetermined path around a driving roller 2207, idler rollers 2209, 2209*a* and a tension roller 2210. The belt is rotated by a belt driving motor 2208 connected to the driving roller 2207 and driven by a motor driver 2221.

The belt 2206 travels in the direction X immediately below the ejection outlets of the heads 2201*a*–2201*d*. Here, the downward deviation is suppressed by the fixing member 2226.

Designated by a reference numeral 2217 is a cleaning unit for removing paper dust or the like from the surface of the belt 2202.

Reference numeral 2212 is a charger for electrically charging the belt 2206. The charger 2212 is actuated or deactuated by a charger driver 2222 so that the recording sheet is attracted on the belt 2206 by electrostatic attraction force.

Before and after the charger 2212, there are provided pinch rollers 2211 and 2211*a* to cooperate with the idler rollers 2209 and 2209*a* to urge the recording sheet 2227 to the belt 2206.

Reference numeral 2232 designates a sheet feeding cassette. The recording sheets 2227 in the cassette is fed out one-by-one by a pick up roller 2216 driven by a motor driver 2223. It is further fed to a mountain like guide 2213 in X direction by feeding roller 2214 and a pinch roller 2215 driven by the driver 2223. The guide 2213 defines a mountain like space to permit deformation of the recording sheet.

Reference numeral 2218 designates a sheet discharge tray to which the recording sheet is discharged after the printing or recording operation.

The above-described head driver 2220, head moving means 2224, cap moving means 2225, motor drivers 2221 and 2223 and the charger driver 2222 are all controlled by a control circuit 2219. In the embodiments described above, the ink is used as the liquid. In place thereof, however, the use can be made with an ink which is solid under the room temperature or lower, but softened or liquefied at the room temperature. In the ink jet recording system, the ink itself is kept at the temperature of 30–70) ° C. to stabilize the ink viscosity within a predetermined range. Therefore, the ink is usable if it is in the form of liquid upon the recording signal application. The ink may be solid if it is liquefied upon heating.

The present invention is applicable to a textile printer or to a textile printing system incorporating the textile printer and the pre-processing apparatus and a post-processing apparatus to which the long size ink jet head is highly desirable. Therefore, fine and high quality print is permitted in the textile printing apparatus and system.

In addition, the present invention is also applicable to a facsimile machine, a copying machine, or printer, and in that case, the prints without image disturbance can be formed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A manufacturing method for manufacturing an ink jet recording head including a plurality of ink ejection outlets arranged in an array; a first member having a plurality of grooves in fluid communication with said ejection outlets, respectively; a second member having a plurality of energy generating elements for producing energy for ejecting ink in said grooves through said ejection outlets; and a clamping unit for clamping said first member to said second member to constitute ink passages with said grooves, said method comprising the steps of:

preparing said clamping unit, wherein said clamping unit has a plurality of clamping portions arranged along the array of said ejection outlets, each said clamping portion having a through hole and a rear end, and each said clamping portion applying a clamping force;

applying a releasing force to each of said clamping portions in a direction causing a release of said clamping force exerted by said clamping portions, said releasing force being applied by engaging a tool member with said through holes;

placing said first member onto said second member under said clamping unit, after said step of applying said releasing force; and releasing the releasing force so that said clamping portions clamp said first member and said second member together.

2. A method according to claim 1, wherein said recording head is a line head which substantially covers an entire width of a recording material.

3. A method according to claim 1, wherein said force is regulated by said tool member.

4. A method according to claim 3, wherein the rear ends of said clamping portions are projected beyond a supporting member for supporting said clamping portions, and the rear ends are engageable with the tool member through openings formed in the supporting member.

5. A method according to claim 1, further comprising a plurality of said second members.

6. A method according to claim 5, wherein said clamping portions correspond to said second members respectively.

7. A method according to claim 5, wherein said clamping portions bridge over said second members.

8. A method according to claim 1, wherein the tool member is a screw.

9. A method according to claim 1, wherein said first member comprises a resin material insert-molded with a supply tube therein.

10. A manufacturing method for manufacturing an ink jet recording head including a plurality of ink ejection outlets arranged in an array; a first member having a plurality of grooves in fluid communication with said ejection outlets, respectively; a second member having a plurality of energy generating elements for producing energy for ejecting ink in said grooves through said ejection outlets; and a clamping unit for clamping said first member to said second member to constitute ink passages with said grooves, said method comprising the steps of:

preparing said clamping unit, wherein said clamping unit has a plurality of clamping portions arranged along the array of said ejection outlets, each said clamping portion having a through hole, each said clamping portion applying a clamping force;

applying a releasing force to each of said clamping portions in a direction causing a release of said clamping force exerted by said clamping portions, said releasing force being applied by engaging a tool member with said through holes;

placing said first member onto said second member under said clamping unit, after said step of applying said releasing force;

releasing the releasing force so that said clamping portions clamp said first member and said second member together; and supplying sealing material through said openings to apply the sealing material to a connecting portion between said first member and said second member.

11. An ink jet recording head comprising:

a plurality of ink ejection outlets arranged in an array;

a first member having a plurality of grooves in fluid communication with said ejection outlets, respectively;

a second member having a plurality of energy generating elements for producing energy for ejecting ink in said grooves through said ejection outlets; and a clamping unit for clamping said first member to said second member to constitute ink passages with said grooves, said ink jet recording head having been manufactured by the steps of preparing said clamping unit, wherein said clamping unit has a plurality of clamping portions arranged along the array of said ejection outlets, each said clamping portion having a through hole, each said clamping portion applying a clamping force, applying a releasing force to each of said clamping portions in a direction causing a release of said clamping force exerted by said clamping portions, said releasing force being applied by engaging a tool member with said through holes, placing said first member onto said second member under said clamping unit, after said step of applying said releasing force, releasing the releasing force so that said clamping portions clamp said first member and said second member together, and supplying sealing material through said openings to apply the sealing material to a connecting portion between said first member and said second member.

* * * * *

UNITED STATES PATENT AND TRADEMARK OFFICE

CERTIFICATE OF CORRECTION

PATENT NO. : 6,168,254 B1
APPLICATION NO. : 08/916948
DATED : January 2, 2001
INVENTOR(S) : Seiichiro Karita et al.

It is certified that error appears in the above-identified patent and that said Letters Patent is hereby corrected as shown below:

IN THE DRAWINGS:

Sheet 9 of 17, FIG. 9, "3201d" should read --2201d--;
"3201c" should read --2201c--;
"3201b" should read --2201b--; and
"3201a" should read --2201a--.

COLUMN 1:

Line 63, "board 1." should read --board 100.--.

COLUMN 2:

Line 30, "increase" should read --increased--;
Line 47, "outlet" should read --outlets--; and
Line 50, "a ink" should read --an ink--.

COLUMN 3:

Line 4, "openings," should read --opening,--;
Line 21, "openings," should read --opening,--;
Line 52, "a" should read --the--; and
Line 62, "heed" should read --head--.

COLUMN 4:

Line 5, "Vet" should read --jet--;
Line 30, "board 100 per" should read --boards 100 are--;
Line 49, "FIGS. 4(a-c)" should read --FIGS. 4(a-c),--;
Line 50, "FIGS. 4(a-c)" should read --FIGS. 4(a-c),--; and
Line 52, "elements 100" should read --elements 101--.

COLUMN 6:

Line 5, "length," should read --length--;
Line 28, "a" should read --an--;
Line 37, "tool 100" should read --tool 1000--; and
Line 38, "urging force" (second occurrence) should read --leaf spring--.

UNITED STATES PATENT AND TRADEMARK OFFICE

CERTIFICATE OF CORRECTION

PATENT NO. : 6,168,254 B1
APPLICATION NO. : 08/916948
DATED : January 2, 2001
INVENTOR(S) : Seiichiro Karita et al.

It is certified that error appears in the above-identified patent and that said Letters Patent is hereby corrected as shown below:

COLUMN 9:

Line 9, "board" should read --board 100--;
Line 21, "comfining" should read --confining--;
Line 29, "Jet" should read --jet--;
Line 31, "late 3200" should read --plate 3200--; and
Line 33, "having a" should read --having an--.

COLUMN 10:

Line 13, "holder 202." should read --holder 2202.--;
Line 14, "means 224." should read --means 2224.--;
Line 15, "head cap 2203*a*-2203*d*" should read --head caps 2203*a*-2203*d*--;
Line 30, "than" should read --by--;
Line 33, "sheet 227" should read --sheet 2227--;
Line 47, "belt 2202." should read --belt 2206.--; and
Line 58, "is" should read --are--.

COLUMN 11:

Line 8, "30-70) ° C." should read --30-70°C.--; and
Line 44, "the the" should read --the--.

COLUMN 14:

Line 10, "of" should read --of:--; and
Line 30, "member." should read -- member together ¶12. A manufacturing method for manufacturing an ink jet recording head including a plurality of ink ejection outlets arranged in an array; a first member having a plurality of grooves in fluid communication with said ejection outlets, respectively; a second member having a plurality of energy generating elements for producing energy for ejecting ink in said grooves through said ejection outlets; and a clamping unit for clamping said first member to said second member to constitute ink passages with said grooves, said method comprising the steps of:

preparing said clamping unit, wherein said clamping unit has a plurality of clamping portions arranged along the array of said ejection outlets;

applying a releasing force to each of said clamping portions in a direction causing a release of said clamping force exerted by said clamping portions, said releasing forces and said clamping forces being individually controllable for respective clamping portions, independently from each other;

UNITED STATES PATENT AND TRADEMARK OFFICE

CERTIFICATE OF CORRECTION

PATENT NO. : 6,168,254 B1
APPLICATION NO. : 08/916948
DATED : January 2, 2001
INVENTOR(S) : Seiichiro Karita et al.

It is certified that error appears in the above-identified patent and that said Letters Patent is hereby corrected as shown below:

placing said first member onto said second member under said clamping unit, after said step of applying said releasing force; and releasing the releasing force so that said clamping portions clamp said first member and said second member together.

13. A manufacturing method for manufacturing an ink jet recording head including a plurality of ink ejection outlets arranged in an array; a first member having a plurality of grooves in fluid communication with said ejection outlets, respectively; a second member having a plurality of energy generating elements for producing energy for ejecting ink in said grooves through said ejection outlets; and a clamping unit for clamping said first member to said second member to constitute ink passages with said grooves, said clamping unit having a clamping portion exerting a clamping force, said method comprising the steps of:

preparing said clamping unit;

applying a releasing force to said clamping portion in a direction causing a release of said clamping force exerted by said clamping portion;

placing said first member onto said second member under said clamping unit, after said step of applying said releasing force; and releasing the releasing force so that said clamping portion clamps said first member and said second member together.--.

Signed and Sealed this

Seventeenth Day of October, 2006

JON W. DUDAS
*Director of the United States Patent and Trademark Office*